US005993725A

United States Patent [19]

Zuk et al.

[11] Patent Number: 5,993,725

[45] Date of Patent: Nov. 30, 1999

[54] METHOD OF FORMING COMPLEX-SHAPED HOLLOW CERAMIC BODIES

[75] Inventors: Karlene J. Zuk, Hathorne; Jeffrey T. Neil, North Reading, both of Mass.; Christopher A. Tarry, Portsmouth, N.H.

[73] Assignee: Osram Sylvania Inc., Danvers, Mass.

[21] Appl. No.: 09/165,979

[22] Filed: Oct. 2, 1998

[51] Int. Cl.[6] ..... B28B 1/30

[52] U.S. Cl. ..... 264/635

[58] Field of Search ..... 264/610, 635

[56] References Cited

U.S. PATENT DOCUMENTS

| | | | |
|---|---|---|---|
| 3,345,160 | 10/1967 | Miccioli | 264/635 |
| 3,528,809 | 9/1970 | Farnand | 264/635 |
| 3,907,949 | 9/1975 | Carlson | 264/635 |
| 4,999,145 | 3/1991 | Thibodeau | 264/635 |
| 5,173,229 | 12/1992 | Miyamoto | 264/635 |
| 5,738,819 | 4/1998 | Feagin | 264/635 |

OTHER PUBLICATIONS

Abstract of JP 59–62104, Sep. 1982.

Abstract of German DE 3132141 C1, Dec. 1982.

*Primary Examiner*—Christopher A. Fiorilla
*Attorney, Agent, or Firm*—William H. McNeill

[57] ABSTRACT

A method of forming hollow bodies of ceramic material suitable for use as the discharge vessels of high intensity discharge lamps includes forming a fugitive core of substantially pure graphite having a configuration matching the interior configuration of the hollow body. A flowable powder, including binders, of the ceramic material is formed and added to fill the annular space between a flexible elastomeric mold defining the outer contour and the fugitive core defining the inner contour. The ceramic powder is isostatically compressed in the mold about the core to form a sub-assembly. The sub-assembly is removed from the mold, heated at a rate and time and in a suitable atmosphere to volatilize the fugitive core, and subsequently the sub-assembly is sintered to form the hollow body.

5 Claims, No Drawings

METHOD OF FORMING COMPLEX-SHAPED HOLLOW CERAMIC BODIES

TECHNICAL FIELD

This invention relates to a method of forming high-purity, hollow ceramic bodies of complex shape. More particularly, the invention relates to a method for forming complex shaped polycrystalline alumina bodies suitable for use as the arc tubes in discharge lamps.

BACKGROUND ART

Polycrystalline alumina (PCA) arc tubes have been employed for many years in high pressure sodium (HPS) lamps. Recently, such arc tubes have found important application for metal halide lamps where non-cylindrically shaped arc tubes have shown advantages for improved efficacy. Such non-cylindrical shapes include elliptical and bulgy geometries.

Prior art methods for forming these arc tubes have employed cold isostatic pressing; slip casting; tape casting, injection molding; blow molding; gel casting or extrusion. While these methods have worked well with simple cylindrical shapes, intricately shaped, one-piece and complex parts are often limited by the difficult and sometimes impossible removal of the structural core material used to define the internal geometry. Further, contamination caused by contact with core materials often leads to problems, especially in optical ceramics where high purity is a requirement. Extrusion and blow molding of hollow ceramic bodies can show warpage due to the plastic flow of the wetted extrusion mixture, distorting or even collapsing the cavity or allowing variable wall thickness due to diameter expansion or variation in the material stiffness. Pressed or cast one-piece parts are limited in shape due to the inability to remove the mandrel or core. If cast without a core, the interior geometry is variable, often requiring expensive diamond grinding of the sintered parts.

It would be an advance in the art to provide a production-viable method of manufacturing complex-shaped arc tubes of PCA suitable for use as the discharge vessels of HPS and metal halide lamps.

DISCLOSURE OF INVENTION

It is, therefore, an object of the invention to obviate the disadvantages of the prior art.

It is another object of the invention to enhance the manufacture of intricately-shaped, ceramic bodies.

Still another object of the invention is to enhance the forming processes and manufacturing of ceramic articles by the use of a fugitive core material that leaves no residue.

It is yet another object of the invention to maintain the high-purity and inherent chemical and physical characteristics of the ceramic during the forming process to the final densified article.

These objects are accomplished, in one aspect of the invention, by the provision of a method of forming hollow bodies of ceramic material which comprises forming a fugitive core having a configuration matching the interior configuration of the hollow body; forming a vehicle, including binders, of the ceramic material; covering the fugitive core with the ceramic material; compressing the ceramic material in a mold about the core to form a sub-assembly; removing the sub-assembly from the mold; heating the sub-assembly at a rate and time and in a suitable atmosphere to volatilize the fugitive core; and subsequently sintering the sub-assembly to form the hollow body.

In a more particular embodiment, the body is formed by assembling a mold comprising a fugitive core defining the interior contour and a flexible elastomeric material defining the outer contour. The vehicle containing the ceramic material is poured into the space between the elastomer mold and core and the mold, and thereby the ceramic powder contained therein, is compressed to form the sub-assembly, which is then finished as above.

In a preferred embodiment of the invention, the fugitive core is formed from high-purity graphite.

This method allows the manufacture of complex shapes of ceramic suitable for use as discharge vessels in HPS lamps and metal halide lamps in a production-viable, cost effective, manner.

BEST MODE FOR CARRYING OUT THE INVENTION

For a better understanding of the present invention, together with other and further objects, advantages and capabilities thereof, reference is made to the following disclosure and appended claims.

Referring now to the invention with greater particularity, complex-shaped ceramic bodies are made by the use of a fugitive core. In a preferred embodiment of the invention, the core is formed from a high-purity graphite. By high purity graphite is meant a material that is at least 99.99% pure carbon.

To manufacture the arc tube of the invention, a core of desired shape, for example, elliptical, is prefabricated of high-purity graphite which will react to form $CO_2$ during heating in an oxygen-containing atmosphere. Traditional graphite machining methods are used to form the cores.

A vehicle, such as an aqueous slurry of body material containing suitable binders and platisizers is prepared and spray-dried. The spray-dried material, which is now a flowable powder, is poured into a polyurethane wet-bag mold equipped with the graphite core and cold isostatically pressed to 12,000 psi. The intact ceramic body containing the graphite core is removed from the mold and heated to 1325° C. in air at a rate of 300° C. per hour and the temperature is held at 1325° C. for a time necessary to convert all of the graphite to carbon dioxide. For most applications, this time will be about 24 hours. The now hollow body is then sintered in a reducing atmosphere, such as 8% hydrogen and 92% nitrogen, at a temperature of 1900° C.

The following examples illustrate, in a non-limiting manner, the invention.

EXAMPLE I

Spray-dried alumina powder containing 0.5 weight percent of an organic binder such as polyvinyl alcohol and 2.0 weight percent of a plasticizer such as polyethylene glycol was loaded into a polyurethane wet-bag mold with an elliptically shaped cavity and equipped with a smaller diameter elliptically-shaped high-purity graphite core (for example, Bay Carbon, Inc. grade SPK) threaded on a tungsten carbide mandrel. The binder-containing alumina powder filled the void between the polyurethane and the central graphite core. The alumina filled wet-bag was sealed and isostatically pressed at 12,500 psi to form a green body. After pressing, the alumina green body with mostly encapsulated graphite core was removed from the wet-bag and mandrel and the green body was fired at 1325° C. in air until the graphite and binder were fully volatilized. The presintered, now hollow ceramic body was then sintered by firing in an 8% hydrogen, 92% nitrogen atmosphere at 1900° C. for 2 hours, resulting in a hollow, bulgy-shaped, one-piece translucent body suitable for use as the discharge vessel of a high intensity discharge lamp. High intensity discharge lamps include, but are not limited to, metal halide lamps and high pressure sodium lamps.

EXAMPLE II

The identical procedure as Example I was followed except that the amount of binder was increased to 1.0 weight percent and no plasticizer was used. The resultant ceramic body was also suitable for use as a discharge vessel in high intensity lamps, showing that the process is robust enough to withstand variations in binder/plasticizer levels and ratios.

While there have been shown and described what are at present considered the preferred embodiments of the invention, it will be apparent to those skilled in the art that various changes and modifications can be made herein without departing from the scope of the invention as defined by the appended claims.

What is claimed is:

1. In a method of forming an arc tube for a high intensity discharge lamp, said arc tube being a hollow body of ceramic material the steps comprising:

forming a fugitive core of high purity graphite having a configuration matching the interior configuration of said hollow body;

forming a flowable powder, including binders, of said ceramic material;

assembling a mold comprising said fugitive core defining the inner contour of said body and a flexible elastomeric material defining the outer contour of said body;

pouring said ceramic material into the space between said elastomeric mold and said core;

compressing said ceramic material in said mold about said core at a pressure of about 12,000 psi to form a sub-assembly;

removing said sub-assembly from said mold;

heating said sub-assembly in air to a temperature of about 1325° C. at a rate of 300° C. per hour and maintaining at said temperature for a time sufficient to volatilize said fugitive core;

and subsequently sintering said sub-assembly to form said arc tube hollow body.

2. The method of claim 1 wherein said flowable material is spray-dried alumina and said binder comprises polyvinyl alcohol.

3. The method of claim 2 wherein said fugitive core has an elliptical shape.

4. The method of claim 2 wherein said fugitive core is threaded upon a tungsten-carbide mandrel.

5. The method of claim 1 wherein said flowable material is spray-dried alumina and said binder comprises polyvinyl alcohol and includes a plasticizer of poly ethylene glycol.

* * * * *